US007291362B2

(12) United States Patent
Pekurovsky et al.

(10) Patent No.: US 7,291,362 B2
(45) Date of Patent: Nov. 6, 2007

(54) METHOD AND APPARATUS FOR CONTROLLING COATING WIDTH

(75) Inventors: Mikhail L. Pekurovsky, Bloomington, MN (US); William B. Kolb, Woodbury, MN (US); Joan M. Noyola, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/760,794

(22) Filed: Jan. 20, 2004

(65) Prior Publication Data

US 2005/0155549 A1 Jul. 21, 2005

(51) Int. Cl.
*B05D 3/12* (2006.01)

(52) U.S. Cl. ..... 427/356; 118/410; 118/419; 118/DIG. 2

(58) Field of Classification Search ..... 118/410, 118/261, 419, DIG. 4, 411, DIG. 2; 264/176.1, 264/177.16; 427/356, 421, 286–288; 425/461, 425/467, 463, 382.4, 381, 90, 113
See application file for complete search history.

(56) References Cited

U.S. PATENT DOCUMENTS 4,135,477 A 1/1979 Ridley
4,299,186 A * 11/1981 Pipkin et al. ..... 118/407
4,577,362 A * 3/1986 Tanaka et al. ..... 15/256.5
5,067,432 A 11/1991 Lippert
5,114,753 A * 5/1992 Shibata et al. ..... 427/286
5,198,030 A 3/1993 Franke
5,389,150 A 2/1995 Baum et al.
5,411,589 A * 5/1995 Yoshida et al. ..... 118/688
5,435,847 A * 7/1995 Shibata et al. ..... 118/410
5,670,214 A * 9/1997 Saito et al. ..... 427/356
5,759,274 A 6/1998 Maier et al.
5,837,324 A 11/1998 Yapel et al.
5,980,992 A 11/1999 Kistner et al.
5,998,549 A 12/1999 Milbourn et al.
6,053,978 A * 4/2000 Bernert ..... 118/325

(Continued)

FOREIGN PATENT DOCUMENTS

JP 61257263 * 11/1986

(Continued)

OTHER PUBLICATIONS

Cohn et al, Modern Coating and Drying Technology, 1992, VCH Publishers, pp. 151-155.*

*Primary Examiner*—Brenda A. Lamb
(74) *Attorney, Agent, or Firm*—Rick L. Franzen; James A. Baker

(57) ABSTRACT

A method of applying a material to a moving substrate is disclosed. The method includes providing a die comprising a die body having a cavity therein, wherein the cavity is in fluid communication with an applicator slot. The die is then oriented such that the applicator slot is positioned so as to dispense the material onto the substrate. The material is introduced into the die cavity such that the material is dispensed onto the substrate through the applicator slot. At least one end of the slot includes means for preventing lateral widening of the dispensed material. In another embodiment, means will be disposed at both ends of the applicator slot. The method is particularly useful when the capillary number characteristic of the coating process is less than 0.5

15 Claims, 4 Drawing Sheets

U.S. PATENT DOCUMENTS 6,053,979 A * 4/2000 Bernert et al. ..... 118/325
6,319,316 B1 11/2001 Gibson et al.
6,344,088 B1 * 2/2002 Kamikihara et al. ..... 118/712
6,766,817 B2 7/2004 da Silva

FOREIGN PATENT DOCUMENTS

JP 61257268 * 11/1986

* cited by examiner

METHOD AND APPARATUS FOR CONTROLLING COATING WIDTH

TECHNICAL FIELD

The invention relates generally to coating apparatus and methods. More particularly, the present invention relates to coating apparatus and methods adapted for use when the capillary number characteristic of the process is low.

BACKGROUND

Coating a fluid onto a web of material is well known. Such coating can often be conveniently done using a coating die having a cavity communicating with an applicator slot. Liquid under pressure is introduced into the cavity, and is then extruded out of the applicator slot onto a desired substrate.

Depending on the exact result desired, variations on this theme are numerous, with various coating aids being known. In particular, it is known that under certain conditions, particularly when the speed of the web past the coating die is very rapid, the material dispensed from the applicator slot may neck inwards erratically. One parameter that may be predictive of whether this necking will occur is the so-called "capillary number" characteristic of the coating process.

The capillary number is a dimensionless parameter defined as:

$$Ca = \frac{\mu V}{\sigma}$$

where Ca is the capillary number, μ is the viscosity of the material dispensed or coated at the characteristic shear rate of the coating process, V is the speed of the moving web or other substrate, and μ is the surface tension of the material. At higher capillary numbers, the necking inwards of the edges of the dispensed material is more likely to be a problem.

Various expedients are known by those skilled in the art for controlling this tendency of the dispensed material to pull inwards. The art is replete with mechanical aids to draw the dispensed material back to a predictable width. These are often called "edge guides" in the literature. They are particularly to be seen in descriptions of slide and curtain coating.

However, literature is silent about what might be considered the opposite problem. Recently, attempts to coat high value materials (substrates) in very thin dry layers at very low speeds have resulted in coating of erratic width as capillary forces draw the dispensed material laterally along the gap between the die surface and the substrate at the ends of the applicator slot. This is because the thin dry layers coated onto the high value materials are diluted in a solvent for delivery to the substrate, which reduces viscosity and increases the coating thickness of the coating and solvent mixture delivered to the substrate.

Improvements are desired.

SUMMARY OF THE INVENTION

One aspect of the present disclosure is directed to a method of applying a material to a moving substrate, including providing a die comprising a die body having a cavity therein, wherein the cavity is in fluid communication with an applicator slot. This die is then oriented such that the applicator slot is positioned so as to dispense the material onto the substrate. The material is introduced into the die cavity such that the material is dispensed onto the substrate through the applicator slot. A means is disposed for preventing the widening of the dispensed material laterally of the applicator slot at at least one end of the applicator slot.

Another aspect of the present disclosure is directed to a coating die for dispensing material. The coating die includes a die body having a cavity therein, wherein the cavity is in fluid communication with an applicator slot. The coating die also includes means for preventing outward lateral movement of the dispensed material at at least one end of the applicator slot.

BRIEF DESCRIPTION OF THE DRAWING

In the several figures of the attached drawing, like parts bear like reference numerals, and.

DETAILED DESCRIPTION

In pre-metered coating, such as die coating, it is important for the width of the coated layer to be known to a high degree of accuracy. For the coated layer to be uniform, its width has to be equal to the width of the feed slot. It is, however, common to have some widening of the coating bead past the width of the feed slot, especially at low capillary number flow, such as slow coating speeds and low liquid viscosity. The bead widening causes non-uniformity of coating edges and, sometimes, an instability. These phenomena occur at low capillary number flow, which are typically less than about 0.5, and more typically less than 0.1, and can be less than 0.005, and even 0.001.

The coating bead changes its width when pressure that is generated by capillary forces at the edges of the bead do not match pressure generated in the coating bead. If pressure in the coating bead is larger than a maximum capillary pressure the edge meniscus can sustain, the bead widens; if it is lower than a minimum pressure, the bead narrows. The minimum and maximum capillary pressures depend, among other things, on conditions at the static contact line on the coating die and contact angle between liquid and substrate. The pressures also depend on the flow rate of the dispensed material.

An apparatus and method for controlling the static contact line on the die is disclosed herein. The static contact line can be either pinned or it could move to keep the static contact angle between the liquid and the die constant. When the static contact line is pinned, the range of admissible capillary pressures is the greatest.

Generally, the present disclosure is directed to a coating die having a slot and a pinning location at one or both ends of the slot. The coating die also includes a cavity in fluid communication with the slot. Coating material within the cavity is forced through the slot and then coated onto a substrate. As the coating material exits the slot to form a coating bead, each pinning location holds the coating bead at the pinning location. By pinning the coating bead at each end, control of the coating bead is improved.

Figure 1:
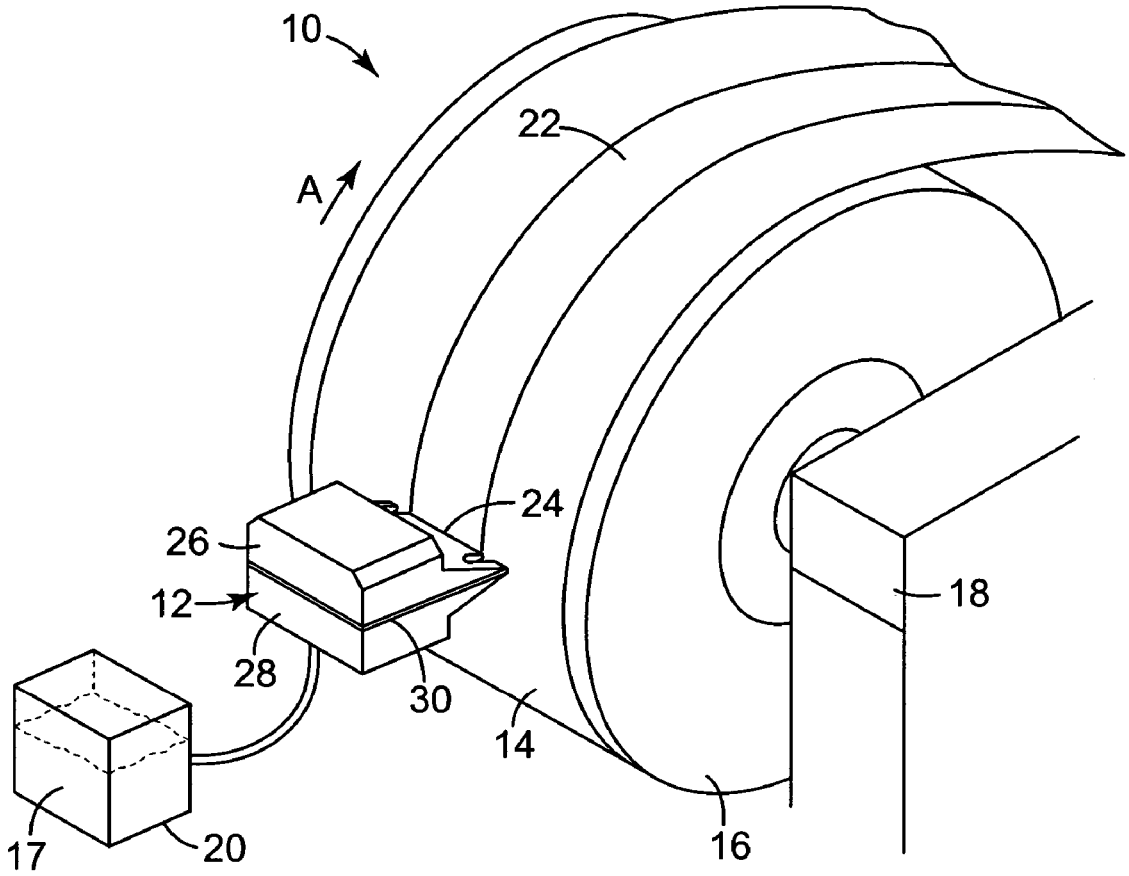
FIG. 1 is a perspective view of an example embodiment of a system including a coating die according to the present disclosure.

Referring to FIG. 1, a perspective view of a portion of an exemplary coating line 10 using a die 12 according to the present disclosure is illustrated. The die 12 is positioned over substrate 14, which in this illustration is a web of indefinite length material moving in direction "A," but could be any other continuous or discrete article requiring coating. The substrate 14 is supported in this motion by a coating roll or drum 16, which is rotatably mounted on support 18. Material 17 to be dispensed by die 12 is delivered by a material supply source 20 and dispensed in a coating 22 upon the substrate 14 through applicator slot 24. Movement of the substrate 14 relative to the applicator slot 24 may be accomplished by any suitable mechanism, for example, by rotating coating roll or drum 16, or by using various web transport systems known to those skilled in the art.

The illustrated embodiment of the die 12 includes a first portion 26, a second portion 28, and a shim 30. However, this construction is merely convenient; for example, the shim 30 and its function are optional, and die 12 could be constructed as a single element. Also, one of ordinary skill in art will appreciate that the die could also include a replaceable and interchangeable lip portion including the applicator slot. Such a replaceable and interchangeable lip portion would allow the same main die body, including the cavity, to be used with various sized applicator slots. An example of such a replaceable and interchangeable lip portion is described in U.S. Pat. No. 5,067,432, to Lippert, which is incorporated by reference herein.

Figure 2:
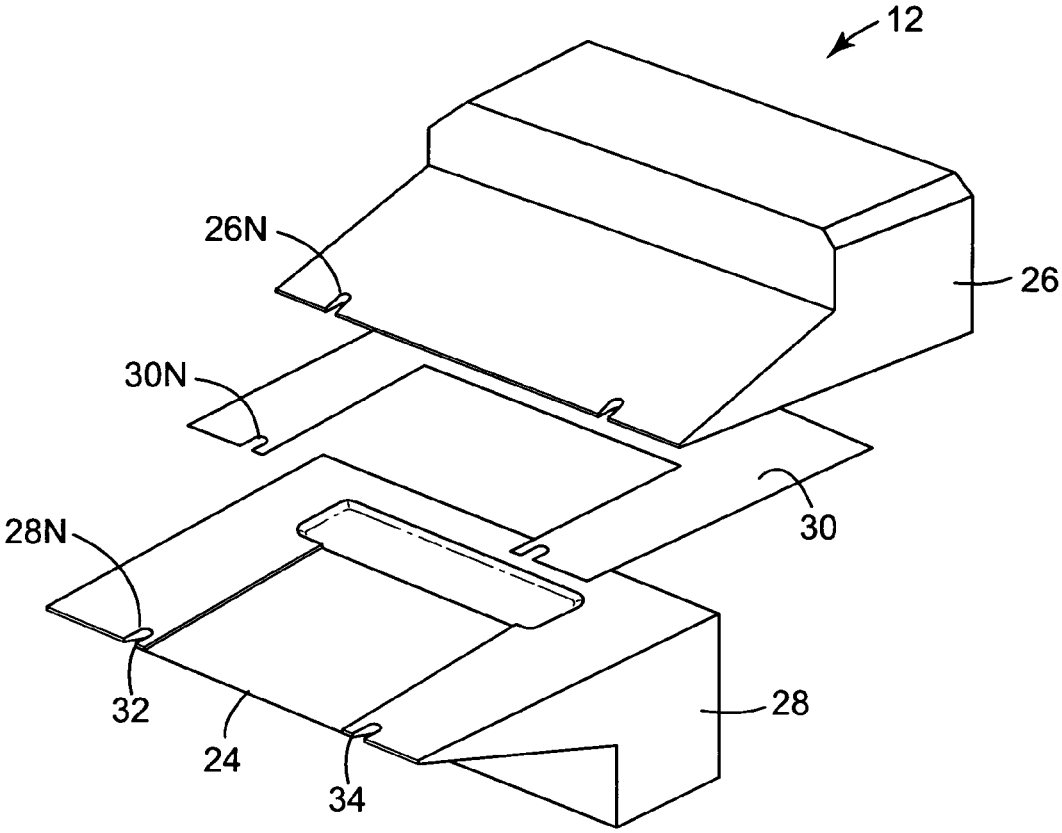
FIG. 2 is an exploded perspective view of the die of FIG. 1.
Figure 3:
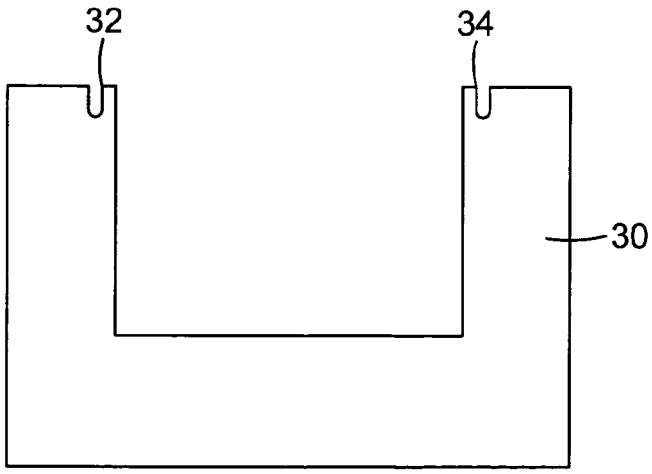
FIG. 3 is a plan view of an exemplary shim according to the present disclosure.

Referring now to FIG. 2, an exploded perspective view of the die 12 is illustrated. In this view it can be better seen that first die portion 26, second die portion 28, and shim 30 each have a pair of notches 26N, 28N, and 30N, respectively, that are in alignment when die 12 is assembled. Together the notches 26N, 28N, and 30N define the lateral edges 32, 34 of the applicator slot 24 and prevent the lateral widening of the coating 22 (in FIG. 1) during operation in low capillary number regimes. Typically, a low capillary number regime exists when the capillary number is less than about 0.1; but as discussed previously, the lower capillary number flow regime can also range up to a capillary number of about 0.5.

Figure 7:
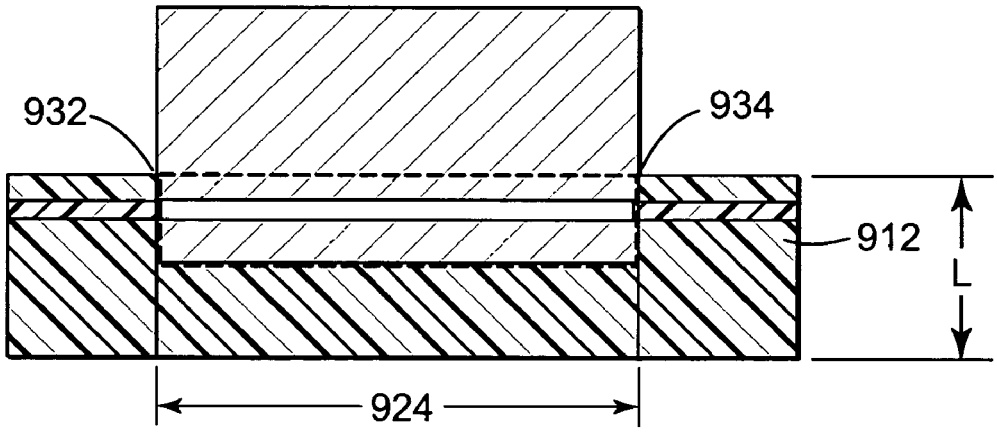
FIG. 7 is a section view of another example embodiment of a coating die according to the present disclosure.

As previously discussed, the present disclosure is directed to preventing widening of the coating bead by providing a pinning location for the edge of the coating bead. In some embodiments, the pinning location can be structural, such as a geometrical step with minimal radius of curvature at the apparent corner. Alternatively, physical properties of materials, such as a rapid or step-change in wetting properties of the die materials of construction, can be used to create a pinning location to prevent lateral widening of the coating bead. Also, the pinning location should span the entire length L of the wetted part of the die in the down web direction (as illustrated in FIG. 7).

Figure 4:
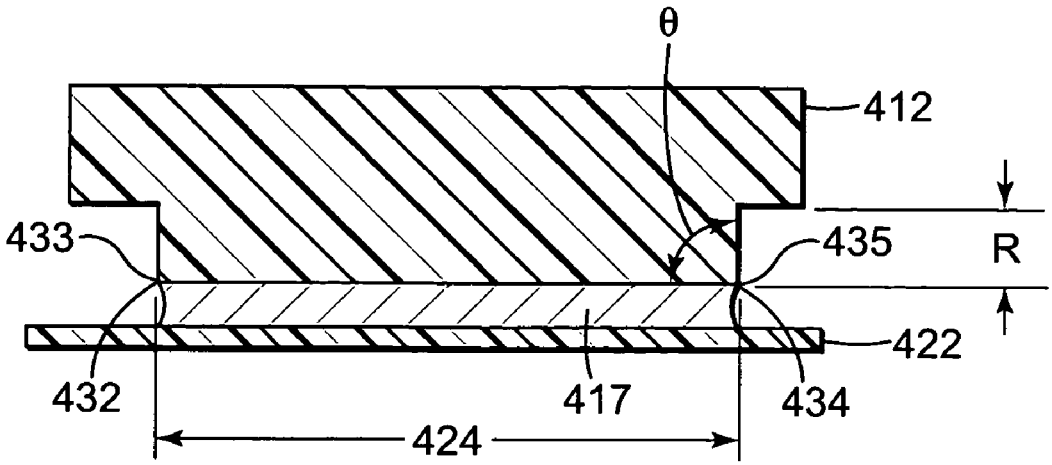
FIG. 4 is a section view of another example embodiment of a coating die according to the present disclosure.
Figure 5:
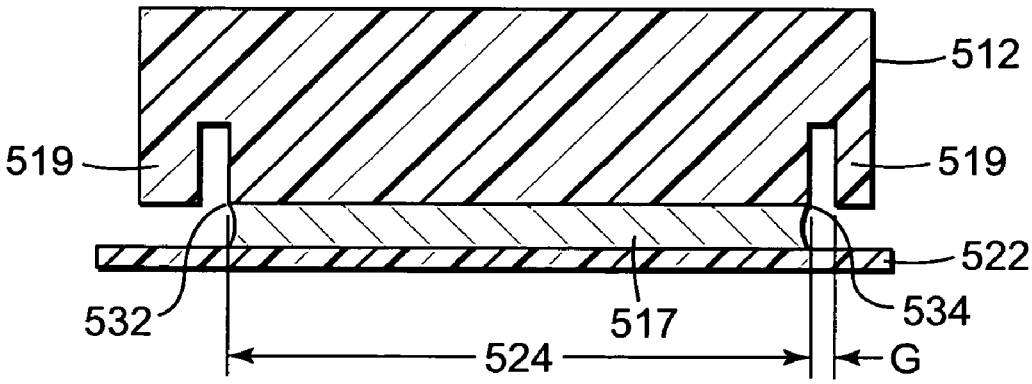
FIG. 5 is a section view of another example embodiment of a coating die according to the present disclosure.
Figure 6:
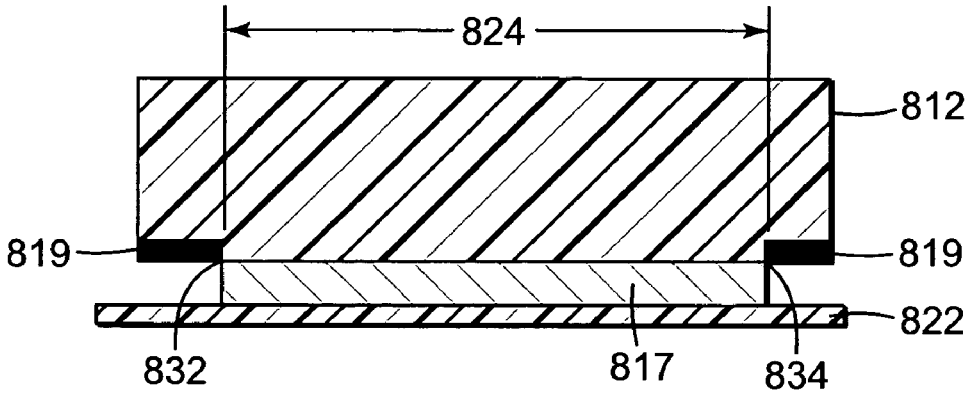
FIG. 6 is a section view of another example embodiment of a coating die according to the present disclosure.

Referring to FIGS. 4-6, illustrated are other example embodiments for creating pinning locations at the edge of the die slot. Referring to FIG. 4, a cross-section of an example embodiment of a coating die 412 is illustrated. The die 412 includes a slot 424 from which coating material 417 is dispensed. The slot 424 includes first 432 and second 434 opposed edges. Each edge 432, 434 includes a corner 433, 435 having a small radius. The small radius acts as a pinning location and the coating material 417 is kept pinned to the corners when coating material 417 is dispensed, thereby preventing lateral widening of the coating bead. The small radius is typically smaller than about 0.050 inches (1.3 millimeters), and ideally is a discontinuity forming an angle θ of about 90 degrees. However, the angle can be more or less than 90 degrees, depending on the particular application where the die is used. Also, the main body of the die 412 should be recessed a sufficient distance R from the pinning corner 435 so that surges and pulsation of the coated material from the die does not creep outside of the pinning corner 435 due to capillary action. While the particular recessed distance R depends on the coating application, for most low capillary number flows, 0.125 inches (3.18 millimeters) is sufficient.

The die of the present disclosure can also be used with a vacuum assisted coating. Referring to FIG. 5, the coating die 512 can also include a sealing member 519 proximate to each end 532, 534 of the slot 524. The sealing members 519 allow the die 512 illustrated in FIG. 4 to be used in a vacuum assisted coating operation. The gap between G between the pinning corner 435 and the sealing member 519 should be a sufficient distance so that surges and pulsation of the coated material from the die does bridge between the pinning corner 435 and the sealing member 519 due to capillary action. While the particular gap distance G depends on the coating application, for most low capillary number flows, 0.063 inches (1.60 millimeters) is sufficient.

Referring to FIG. 6, an example embodiment of a coating die 812 having a slot 824 with pinning locations at each edge 832, 834 of the slot 824 is illustrated. Pinning is accomplished using the physical properties of the die 812 and coating material 817. In the example embodiment shown, the die 812 includes inlays 819 at the edges 832, 834 of the slot 824. The inlays 819 are formed from a poorly or non-wetting material, that is one where the material used for the inlay has a larger static contact angle with the coating material than the material used for the die body. Using a material not wetted by the coating material 817 creates the pinning locations by keeping capillary forces from pulling the coating material 817 onto the inlay 819, thereby preventing lateral widening of the coating bead. Examples of poorly or non-wetting materials are PTFE (polytetrafluoroethylene), sold under the trade designation TEFLON, and acetal polyoxymethylene, sold under the trade designation DELRIN, both available from DuPont. Other materials include release polymers, such as fluoropolymers. Examples of fluoropolymers include basic monomers, such as, tetrafluoroethylene (TFE), vinyl fluoride (VF), perfluoroalkylvinylether (PAVE), 2,2-Bistrifluoromethyl-4,5difuoro-1,3-dioxole (PDD), vinylidene fluoride (VDF), hexafluoropropylene (HFP), and chlorotrifluoroethylene (CTFE); and polymers, such as, fluorinated ethylene propylene (surface energy of about 18-22 dynes/cm), polyvinyl fluoride (surface energy of about 28 dynes/cm), polyethylene copolymer (surface energy of about 20-24 dynes/cm), and silicones (surface energy of about 24 dynes/cm). Other exemplary materials are described in U.S. Pat. No. 5,980,992, to Kistner et al. and U.S. Pat. No. 5,998,549, to Milbourn et al., both of which are incorporated by reference herein.

Alternatively, the die body can be coated with a preferentially wetting material in the wetted region, such as gold plating. The preferentially wetted material keeps the coating bead from migrating or moving laterally out of the pinning location. In another example embodiment, hydrophobic tape can be applied along the edges of the wetted area of the die when using water-based coating materials or solutions.

For each of the example embodiments described, it is preferred that the pinning location spans the entire length L of the slot 924 in the machine direction (as illustrated in FIG. 7). Also, while both edges 932, 934 of the slot 924 typically have identical pinning arrangements, any combination of the types of the pinning locations described can be used, as the particular conditions of the use of the coating die require.

Various modifications and alterations of the present invention will be apparent to those skilled in the art without departing from the scope and spirit of this invention, and it should be understood that this invention is not limited to the illustrative embodiments set forth herein.

The invention claimed is:

1. A system for dispensing material, the system comprising:

a die having a die body having a cavity therein, wherein the cavity is in fluid communication with an applicator slot;

a moving substrate disposed adjacent to the applicator slot for receiving dispensed material, wherein the substrate is supported on a backup roll opposite the applicator slot; and means for preventing the widening of the dispensed material laterally of the applicator slot proximate at least one end of the applicator slot when the capillary number is in a range up to about 0.5, wherein the preventing means comprises a notch adjacent to the at least one end of the applicator slot.

2. The system according to claim 1 further comprising a mechanism for moving a substrate relative to the applicator slot.

3. The system according to claim 2, wherein the substrate is of indefinite length.

4. The system according to claim 1, wherein the preventing means further comprises a region of low surface energy material adjacent to the at least one end of the applicator slot.

5. The system according to claim 1, wherein the preventing means is disposed at both ends of the applicator slot.

6. The system according to claim 1, wherein the preventing means further comprises a region of low surface energy material position within the notch adjacent to the at least one end of the applicator slot.

7. The system according to claim 1, wherein the preventing means further comprises a region of material that is poorly wetted by the dispensed material.

8. The system according to claim 7, wherein the dispensed material is water-based and wherein the poorly wetted material is a hydrophobic material.

9. The system according to claim 8, wherein the hydrophobic material comprises a layer of hydrophobic substrate and a layer of adhesive.

10. A method of applying a material to a moving substrate, comprising the steps of:

providing a die comprising a die body having a cavity therein, wherein the cavity is in fluid communication with an applicator slot;

orienting the die such that the applicator slot is positioned so as to dispense the material onto the substrate;

introducing the material into the die cavity such that the material is dispensed onto the substrate through the applicator slot wherein the material is introduced so that the capillary number characteristic of the dispensing of the material through the applicator slot is no greater than about 0.5 and further wherein a backup roll supports the substrate opposite the applicator slot; and disposing means for preventing the widening of the dispensed material laterally of the applicator slot onto at least one end of the applicator slot, wherein the means for preventing the widening of the dispensed material comprises a notch adjacent to the end of the applicator slot.

11. The method according to claim 10 further comprising disposing a means for preventing the widening of the dispensed material laterally of the applicator slot at both ends of the applicator slot.

12. The method according to claim 10, wherein the material is introduced so that the capillary number characteristic of the dispensing of the substrate through the applicator slot is no greater than 0.1.

13. The method according to claim 10, wherein the material is introduced so that the capillary number characteristic of the dispensing of the substrate through the applicator slot is no greater than 0.01.

14. The method according to claim 10, wherein the means for preventing the widening of the dispensed material further comprises a region of low surface energy material adjacent to the end of the applicator slot.

15. The method according to claim 14, wherein the low surface energy material is selected from the group consisting of polytetrafluoroethylene and acetal polyoxymethylene.

* * * * *